US007458850B1

(12) United States Patent
Burris et al.

(10) Patent No.: US 7,458,850 B1
(45) Date of Patent: Dec. 2, 2008

(54) RIGHT-ANGLED COAXIAL CABLE CONNECTOR

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/805,367

(22) Filed: May 23, 2007

(51) Int. Cl.
*H01R 9/05* (2006.01)

(52) U.S. Cl. ..... 439/582

(58) Field of Classification Search ..... 439/582, 439/578, 902

See application file for complete search history.

(56) References Cited

U.S. PATENT DOCUMENTS

| | | | | |
|---|---|---|---|---|
| 3,297,979 | A | 1/1967 | O'Keefe et al. | 339/177 |
| 4,400,050 | A | 8/1983 | Hayward | 339/177 |
| 4,834,675 | A | 5/1989 | Samchisen | 439/578 |
| 5,002,503 | A | 3/1991 | Campbell et al. | 439/578 |
| 5,338,225 | A | 8/1994 | Jacobsen et al. | 439/585 |
| 5,632,651 | A | 5/1997 | Szegda | 439/578 |
| 5,651,698 | A * | 7/1997 | Locati et al. | 439/578 |
| 6,210,222 | B1 | 4/2001 | Langham et al. | 439/583 |
| 6,283,790 | B1 * | 9/2001 | Idehara et al. | 439/582 |
| 6,790,081 | B2 | 9/2004 | Burris et al. | 439/578 |
| 6,860,761 | B2 * | 3/2005 | Lee et al. | 439/582 |
| 6,916,200 | B2 | 7/2005 | Burris et al. | 439/578 |
| 2005/0159044 | A1 | 7/2005 | Harwath et al. | 439/578 |

* cited by examiner

*Primary Examiner*—Phuong K Dinh
(74) *Attorney, Agent, or Firm*—Robert L. Carlson; Matthew J. Mason

(57) ABSTRACT

A right-angled coaxial cable connector for coupling an end of a coaxial cable to a terminal is disclosed, the right-angled connector includes fewer components and better impedance characteristics. The right-angled coaxial cable connector includes a main body into which a coaxial cable is inserted, a retainer inserted into the main body, and a coupler for connecting the connector to a terminal. The right-angled coaxial cable connector also has a seal disposed between the retainer and the coupler.

19 Claims, 10 Drawing Sheets

RIGHT-ANGLED COAXIAL CABLE CONNECTOR

BACKGROUND OF THE INVENTION

1. Field of the Invention

The present invention relates generally to right-angled coaxial cable connectors, and particularly to right-angled coaxial cable connectors that have fewer components and may be sealed for outside use.

2. Technical Background

Coaxial cable connectors such as F-connectors are used to attach coaxial cables to another object such as an appliance or junction having a terminal adapted to engage the connector. The coaxial cable typically includes a center conductor surrounded by a dielectric, in turn surrounded by a conductive grounding foil and/or braid; the conductive grounding arrangement is itself surrounded by a protective outer jacket. The F-connector is secured over the prepared end of the jacketed coaxial cable by use of a crimp or compression tool specifically designed to actuate the F-connector. Once secured to the coaxial cable, the F-connector is then capable of transferring signals by engaging a threaded connection found on typical CATV electronic devices such as set top converters, television sets or DVD players.

Crimp style F-connectors are known wherein a crimp sleeve is included as part of the connector body. A special radial crimping tool, having jaws that form a hexagon, is used to radially form the crimp sleeve around the outer jacket of the coaxial cable to secure such a crimp style F-connector over the prepared end of the coaxial cable. An example of such a crimp connector is disclosed within U.S. Pat. No. 4,400,050 to Hayward.

Crimping braided outer conductors is problematic. To prevent deformation of the outer conductors in relation to the center conductor, a support sleeve of one form or another may be used. Usually, the braid is captured in a layer between a tubular outer ferrule and the connector body. This crimp is not considered highly reliable. There are typically large voids in the interface allowing for corrosive degradation of the contact surfaces. The mechanical pull strength of the joint does not approach the strength of the wire. Finally, the connection allows relative movement between all 3 components, which results in a very poor, noisy electrical connection.

Another form of an F-connector is known wherein an annular compression sleeve is used to secure the F-connector over the prepared end of the cable. Rather than forming a crimp sleeve radially toward the jacket of the coaxial cable, the F-connectors employ a plastic annular compression sleeve that is initially attached to the F-connector, but which is detached therefrom prior to installation of the F-connector. The compression sleeve includes an inner bore for allowing the compression sleeve to be passed over the end of the coaxial cable prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen; the patent discloses a compression sleeve type F-connector known in the industry as "Snap-n-Seal." A number of commercial tool manufacturers provide compression tools for axially compressing the compression sleeve into such connectors.

Standardized cable preparation tooling and connector actuation tooling have led to a defacto standard in cable preparation dimensions and connector envelope configurations. Additional requirements for both indoor and outdoor use have resulted in connector designs that require a relatively large number of components. Often times these standardized connector and tooling systems are used to manufacture CATV jumper cables in large quantities, causing unnecessary expense to be incurred in the manufacture of CATV jumper assemblies.

Many of the applications noted above employ the use of straight connectors (the longitudinal centerline of the connector is coaxially aligned with the longitudinal centerline of the coaxial cable). There are also applications where the use of a right angle version of the coaxial connector is advantageous. The construction of right angle connectors is typically more complex than the construction of straight connectors because of the difficulty of maintaining mechanical and electrical characteristics of the coaxial structure around a right angle bend. Typically, a fabricated center conductor is captured within the connector body and insulated with various dielectric configurations. Use of this type of approach necessitates a relatively high number of components compared to straight connectors. Additionally, in right angle connectors, it is difficult to achieve comparable electrical performance to that of a straight connector due to interruptions along the center conductor path.

Regardless of the method used to secure the coaxial cable to the F-connector, the F-connector virtually always includes a rotatable nut for securing the F-connector to a threaded port. For F-connectors that are used exclusively indoors, the coupling nut can be free-spinning, as there is no need to create a moisture barrier between the coupling nut and other components of the F-connector. However, it is known in the art that the passage of moisture inside the F-connector can lead to corrosion, increased contact resistance, reduced signal strength, and excessive RF leakage from the connector. Accordingly, when such F-connectors are used outdoors, those skilled in the art have made various efforts to form a seal between the various components of the F-connector, including the joint between the coupling nut and the coupling nut retainer of the F-connector.

For example, the practice of incorporating one or more resilient O-rings between various components of the F-connector has been used to seal out moisture. In U.S. Pat. No. 5,338,225 to Jacobsen, et al., an O-ring is positioned inside the coupling nut just ahead of the tubular post adjacent the internally threaded bore of the nut. However, in this case, the O-ring is contacted by the threaded post and can be degraded by such contact. Moreover, the O-ring is always bearing against both the coupling nut and the end of the tubular post, creating a drag effect that resists rotation of the coupling nut.

It is also known to dispose an O-ring near the opposite end of the coupling nut, trapped between a rearwardly-directed collar of the nut and the cylindrical body portion of the F-connector; such a structure is shown, for example, in U.S. Pat. No. 4,834,675 noted above. During assembly of the connector, the O-ring is pre-compressed between the coupling nut and the cylindrical body to create a seal therebetween; as in the prior example, the O-ring constantly engages both the nut and the cylindrical body and creates drag that resists rotation of the nut. Furthermore, the forces created as the coupling nut is tightened over a threaded post or terminal have no impact on the degree of seal created between the coupling nut and the cylindrical body, i.e., further tightening of the coupling nut over the threaded terminal does not increase the amount of compression of the O-ring. In addition, the creation of the rearwardly-directed collar within the coupling nut increases manufacturing costs because the coupling nut must be machined from both ends.

In most cases, a coaxial cable service technician threads the coupling nut over a threaded terminal by hand, until the nut is hand-tight. The technician then uses a wrench to make a final turn to secure the nut over the threaded terminal. The continuous drag applied by such O-rings to the coupling nut is a nuisance to service technicians, as compared with indoor-type free-spinning coupling nuts because it is more difficult to rotate the coupling nut as it is being hand-tightened over the threaded post.

Therefore, a right angle coaxial cable connector with a reduced number of components that maintains the mechanical and electrical characteristics of the coaxial structure and has a seal for outdoor use is desired.

SUMMARY OF THE INVENTION

Disclosed herein is a right-angled coaxial cable connector that includes a main body having a first end and a second end, and an internal surface extending between the first and second ends of the main body, the internal surface defining a longitudinal opening, the main body also having a first opening at the first end and the second opening adjacent the second end, each opening having a longitudinal axis therethrough, the longitudinal axis of the first opening being generally perpendicular to the longitudinal axis of the second opening, a retainer having a rear end, a front end, and an internal surface extending between the rear and front ends of the retainer, the internal surface defining a longitudinal opening, the retainer disposed through the second opening and into the longitudinal opening of the main body, at least a portion of the rear end of the retainer engaging at least a portion of the internal surface of the main body, and a coupler disposed proximate the front end of the retainer to engage a terminal, the coupler having a portion with a hexagonal outer configuration.

In other embodiments, the connector includes a one-piece continuous electrical conductor that is bent through an angle of about 90°.

In some embodiments, the connector includes a seal disposed between the coupler and the retainer to prevent moisture ingress.

In other embodiments, the connector includes a seal disposed between the main body and the retainer.

In another aspect, a method of making a right angle coaxial cable connector assembly is disclosed, the method including the steps of passing an end of a coaxial cable through a longitudinal opening in a compression sleeve, passing an insulator over a center conductor of the coaxial cable, passing the end of the coaxial cable into a longitudinal opening of a main body through a first end of the main body, the center conductor of the coaxial cable passing out of the longitudinal opening through an opening adjacent a second end of the main body, bending the center conductor about the insulator through an angle of about 90°, centering the bent center conductor in the opening in the second end of the main body, moving the center conductor into a longitudinal opening in a retainer, and inserting the retainer into the opening at the second end of the main body so that the center conductor extends through a front end of the retainer.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
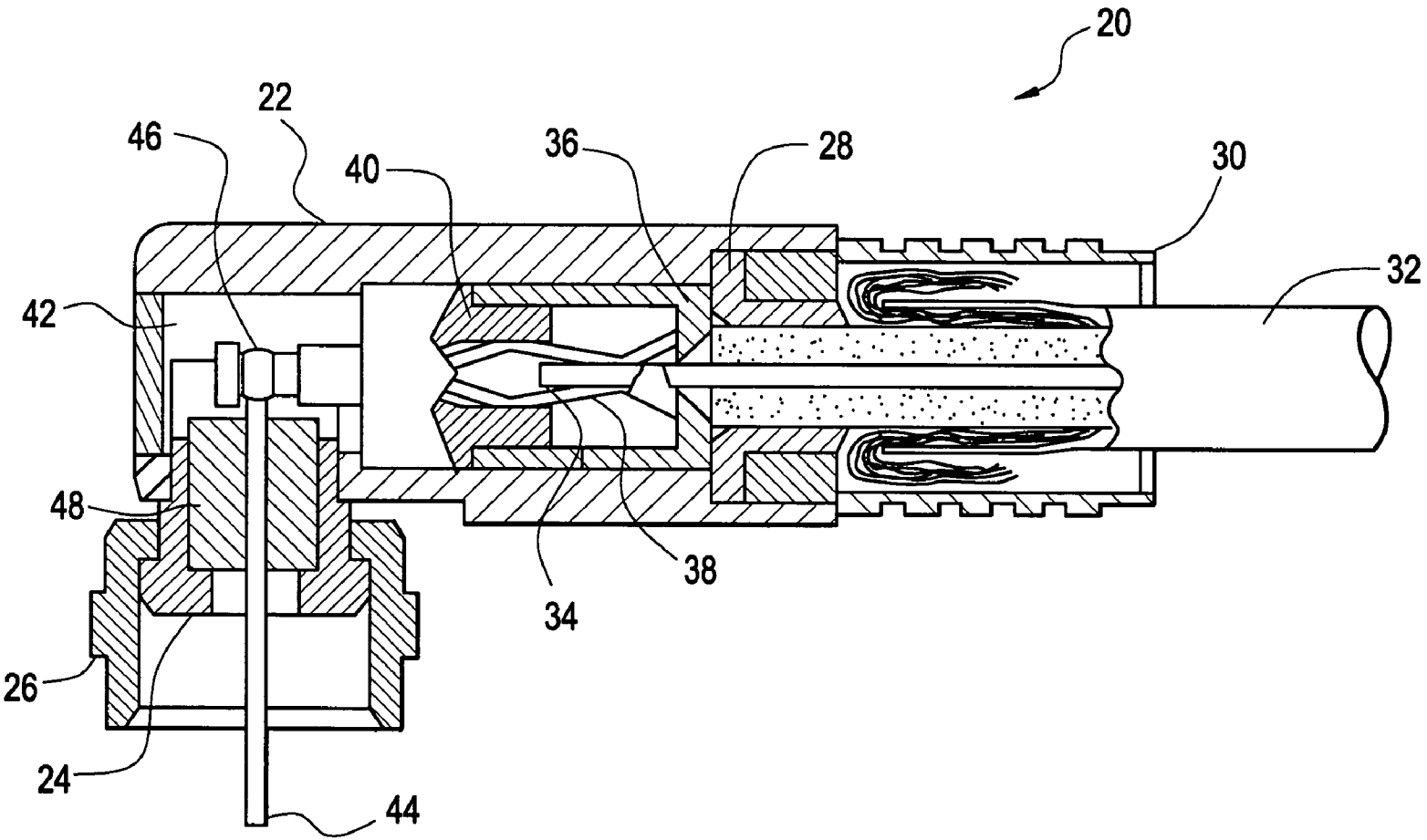
FIG. 1 PRIOR ART
FIG. 1 is a cross-sectional view of a right-angled connector according to the prior art.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIG. 1, a prior art right-angled connector 20 is illustrated. The right-angled connector 20 has a main body 22, into which at one end a nut retainer 24 and coupling nut 26 are press fit. At a second end, the main body 22 has a post 28 and a crimp ring 30 to engage a coaxial cable 32. The central conductor 34 of the coaxial cable 32 passes through an insulator 36 before engaging a flat spring contact 38 that is disposed in a second insulator 40. An electrical conductor 42 is electrically connected to the flat spring contact 38 at one end and soldered to a pin 44 at the other end at solder joint 46. The pin 44 passes through another insulator 48 for connection to a threaded port. Typically, the flat spring contact 38 and central conductor 34 have a poor impedance match, as does the solder joint 46 with the pin 44. Moreover, there are numerous components making up this prior art right-angled connector 20, making the right-angled connector 20 more expensive and more time-consuming to assemble.

Figure 2:
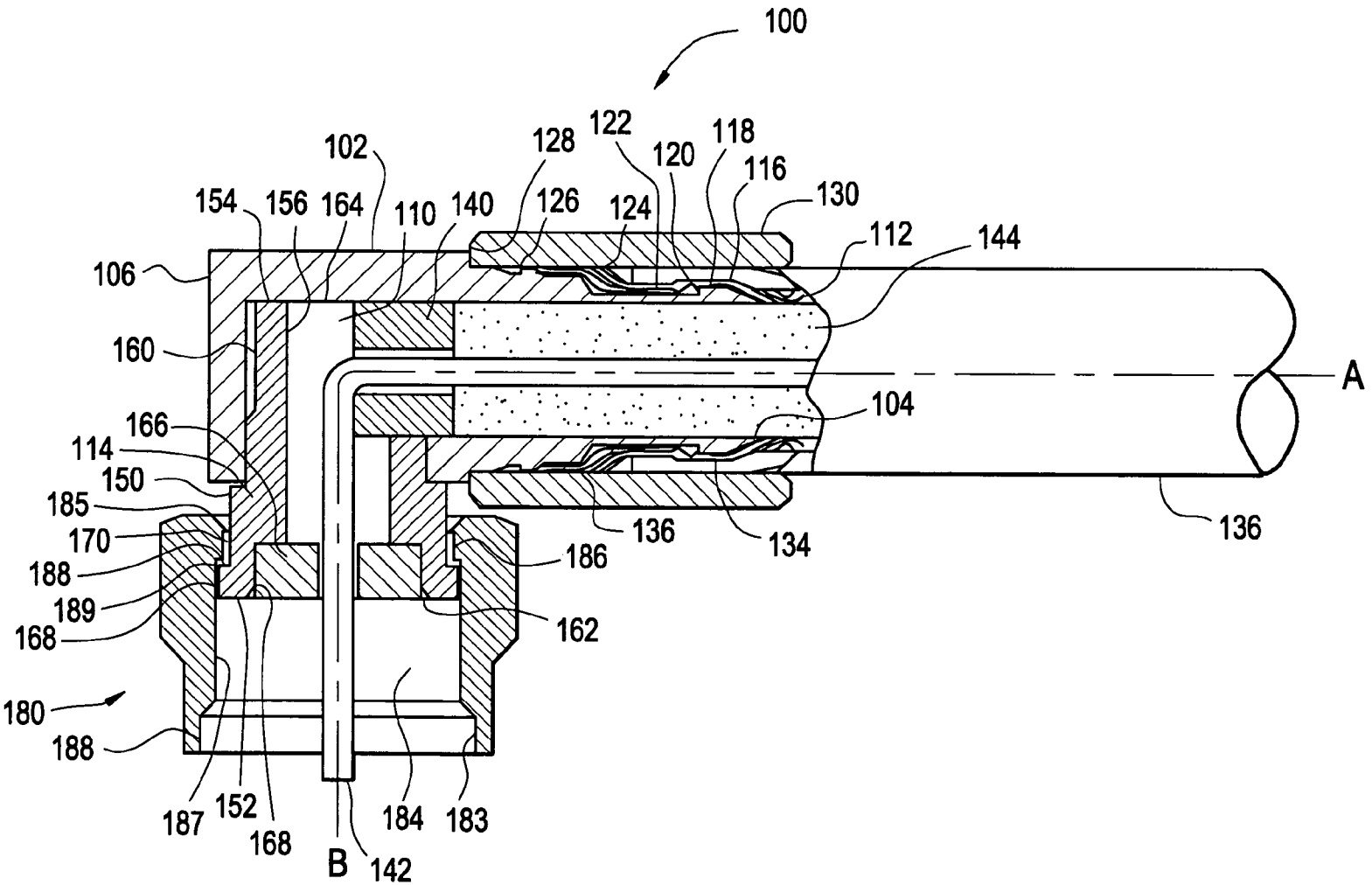
FIG. 2 is a cross-sectional view of a first embodiment of a right-angled connector according to the present invention.
Figure 3:
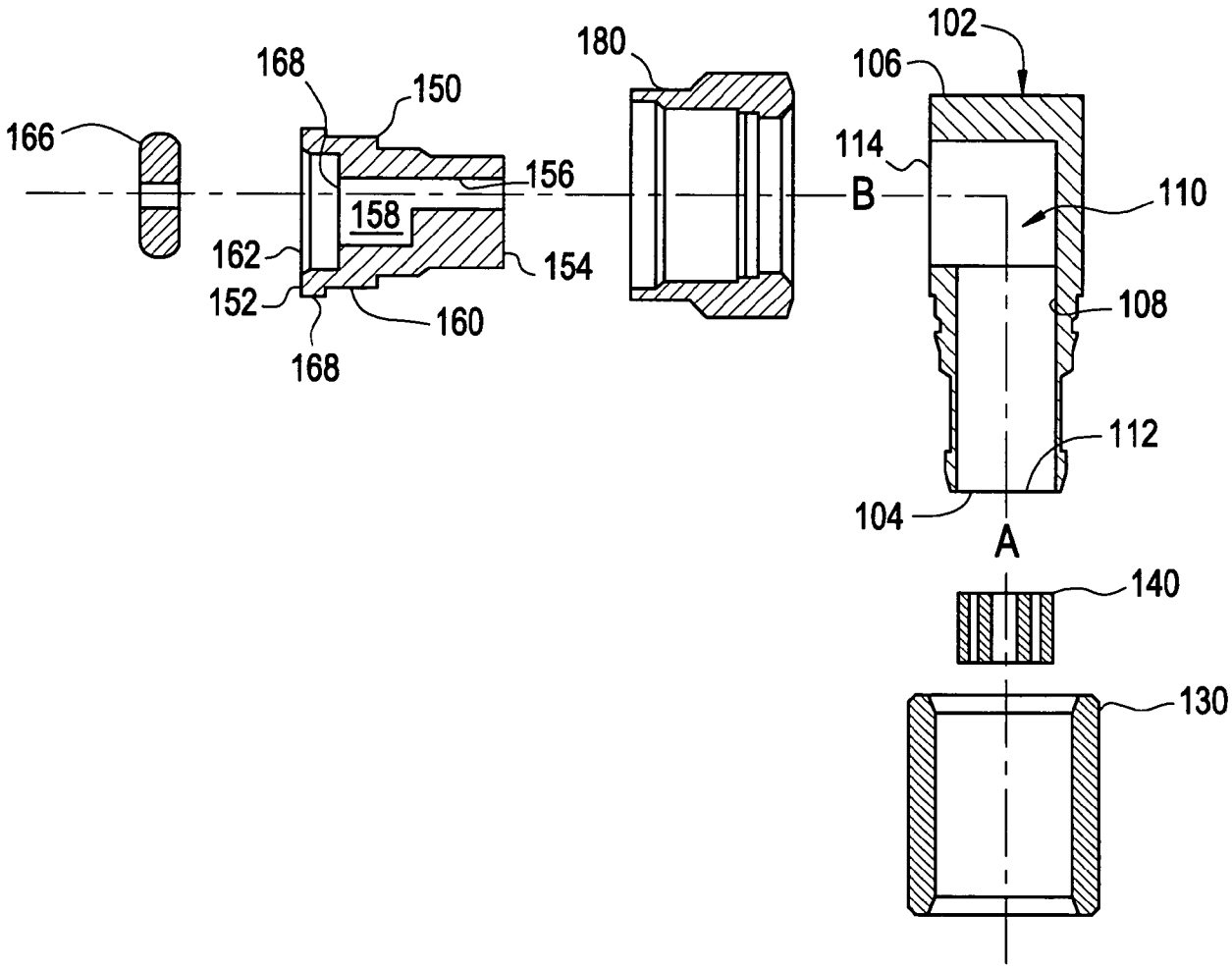
FIG. 3 is an exploded view of several components of the right-angled connector of FIG. 2.

A first embodiment of a right-angled coaxial cable connector 100 according to a first embodiment of the present invention is illustrated in FIGS. 2 and 3. The right-angled coaxial cable connector 100 has a main body 102 with a first end 104, a second end 106, and an internal surface 108 extending between the first end 104 and the second end 106 to define a longitudinal opening 110. The main body 102 has a first opening 112 at the first end 104 and a second opening 114 at the second end 106. The first opening 112 has a longitudinal axis A extending perpendicularly therethrough (and parallel to longitudinal opening 110) and second opening 114 at the second end 106 also has a longitudinal axis B extending perpendicularly therethrough and is perpendicular to the longitudinal axis A that extends through the first opening 112. The main body 102 is preferably made from a conductive material such as brass and is preferably plated with a corrosion resistant material, for example, nickel.

The first end 104 of main body 102 as an external tapered area 116, an outer diameter 118, an external forward facing annular face 120, a reduced diameter portion 122, a second rearward facing tapered portion 124, a forward facing annular face 126, and a rearward facing annular face 128. As illustrated in FIG. 2, the structures at the first end 104 engage and secure, with a compression sleeve 130, the outer cable jacket 134 and braid 136 of a coaxial cable 138. As is known in the art, the first end 104 of main body 102 is inserted into coaxial cable 138 between the inner dielectric 144 and the braid 136. The compression sleeve 130, which is preferably made from metal and plated with a corrosion resistant material such as nickel, is slid over the cable jacket 134 and braid 136 to compressively hold the coaxial cable 138 to the connector 100. The compression sleeve 130 may also be made from an engineered polymer.

The main body 102 also has an insulator 140, which is preferably made from an insulating material such as acetyl or PTFE, that centers and electrically insulates the center conductor 142 of the coaxial cable 138 from the main body 102.

The right-angled coaxial cable connector 100 also has a retainer 150 that has a front end 152, a rear end 154, and an internal surface 156 that defines a longitudinal opening 158 that extends between the front end and rear end 152,154. The retainer 150 is preferably made from an electrically conductive material such as brass and is preferably plated with a conductive material such as tin. The retainer 150 is preferably press-fit into the second opening 114 of the main body 102 such that the rear end 154 engages at least a portion of the internal surface 108 of the main body 102. An outside surface 160 of the retainer 150 also engages the main body 102 at the second opening 114. The retainer 150 has a first opening 162 at the front end 152 and a second opening 164 at the rear end 154. Second opening 164 is positioned such that the insulator 140 and center conductor 142 of coaxial cable 138 pass therethrough and into the longitudinal opening 158 of retainer 150. A second insulator 166 is disposed in a recess 168 at the first opening 162 adjacent the front end 152 to electrically insulate and center the center conductor 142 of coaxial cable 138 in first opening 162.

A coupler 180 rotatably engages an outside surface 160 of retainer 150. Coupler 180 is preferably made from a conductive material such as brass and is plated with a corrosion resistant material, for example nickel. Alternatively, coupler 180 may be constructed from an engineered polymer. The coupler 180 shown in FIGS. 2 and 3 is in the form of a coupling nut, wherein internal surface 183 includes an internal chamfer 185, an inwardly projecting annular ridge 186, internal threads 187, and an internal recess 188. The reduced diameter of annular ridge 186 defines a reduced diameter through-bore section 189 of internal bore 184. The increased diameter of internal recess 188 defines an increased diameter through-bore section 183 of internal bore 184. Coupler 180 may also take other forms in other embodiments.

Coupler 180 is capable of rotating around the retainer 150, that is, the diametral relationship of outside surface 160 and bore 184 allows coupler 180 to rotate about retainer 150 when coupler 180 is disposed about the retainer 150. Forward movement of coupler 180 relative to retainer 150 is restrained by engagement of annular rib 168 and backward facing annular face 170 with the reduced portion 189, thereby preventing coupler 180 from falling off from the front end 152 of retainer 150.

Figure 4A:
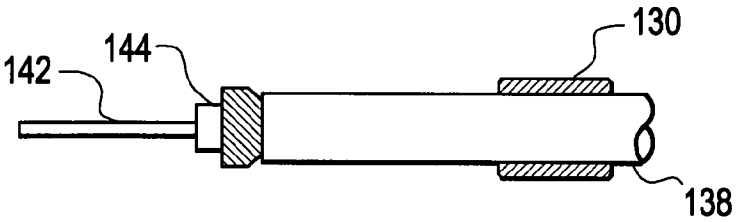
FIGS. 4*a-h* illustrate the installation of a coaxial cable into the right-angled connector of FIG. 2 in accordance with the present invention.
Figure 4B:
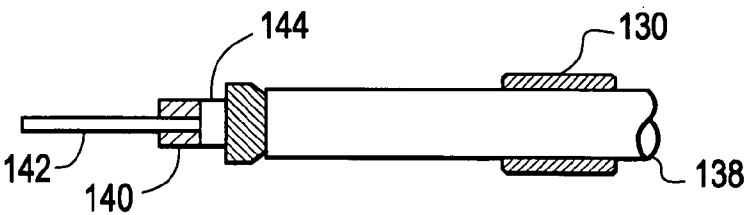
Figure 4C:
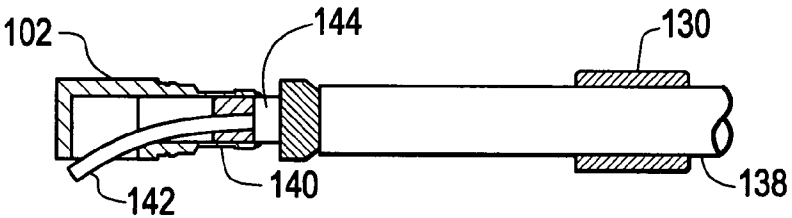
Figure 4D:
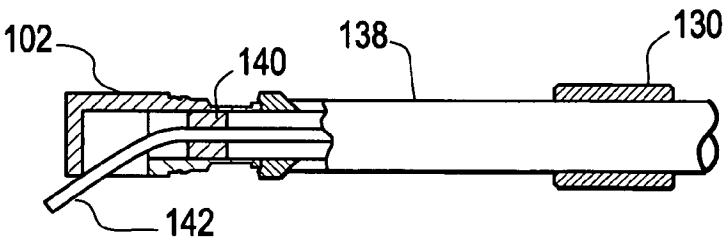
Figure 4G:
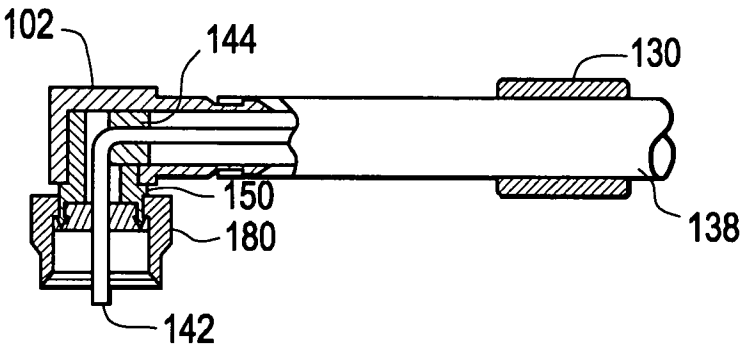
Figure 4H:
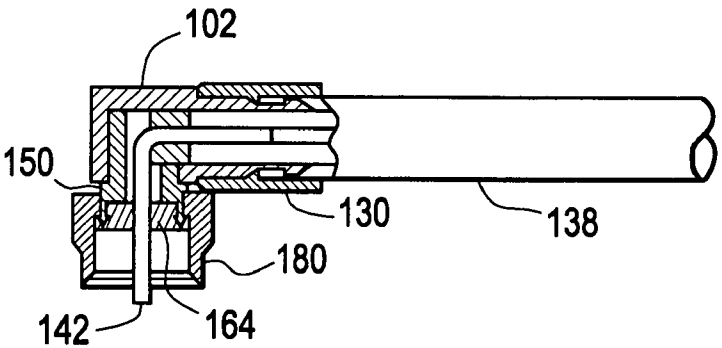
Figure 4E:
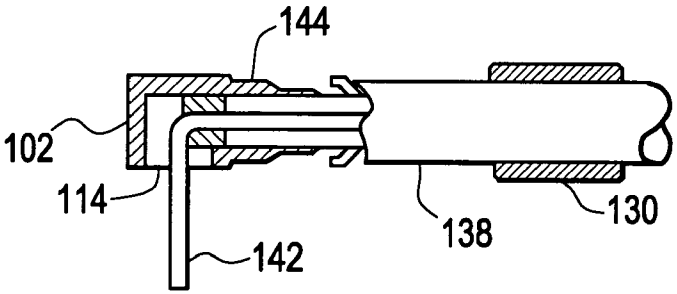
Figure 4F:
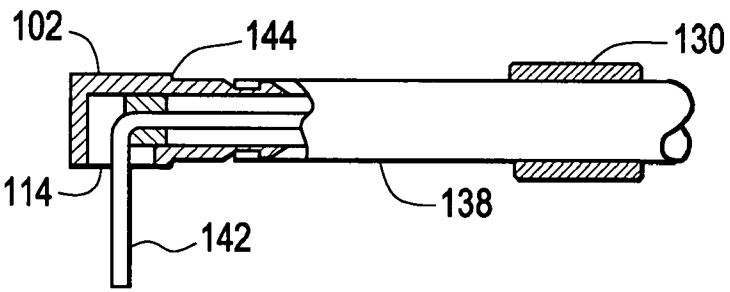

The installation of the right-angled coaxial cable connector 100 will now described in reference to FIGS. 4*a*-4*h*. The compression sleeve 130 is placed over the coaxial cable 138 as illustrated in FIG. 4*a*. The end of coaxial cable 138 has been prepared so that the center conductor 142 is longer than normal, a portion of the inner dielectric 144 is exposed, and only a portion of the braid is exposed. Insulator 140 is placed over the center conductor 142 and pressed up against the inner dielectric 144 as is illustrated in FIG. 4*b*. The center conductor 142 of coaxial cable 138 is bent slightly as it is inserted through first opening 112 at the first end 104 so that the center conductor 142 exits through the second opening 114 at the second end 106 of main body 102. See FIG. 4*c*. Since the second opening 114 is oriented perpendicularly to the first opening 112, the center conductor 142 must be bent so as to pass therethrough. As illustrated in FIG. 4*d*, the first end 104 of main body 102 is inserted between the braid 136 and the inner dielectric 144 of coaxial cable 138. The main body 102 is pushed onto coaxial cable 138 until the front edge of insulator 144 is even with the second opening 114 of main body 102 as shown in FIG. 4*e*. When the front edge of insulator 144 is even with second opening 114, the center conductor 142 is bent to an angle of about 90°. The insulator 144 and the edge of second opening 114 can both be used as fulcrum points to bend center conductor 142 to about 90°. Main body 102 is further pushed onto coaxial cable 138 as illustrated in FIG. 4*f* so that the center conductor 142 is positioned in the center of the second opening 114. Retainer 150 and second insulator 166 are aligned as illustrated in FIG. 4*g* such that the center conductor 142 passes through longitudinal opening 158 and second insulator 166. Retainer 150 is then press-fit into the second opening 114 of main body 102 and second insulator 166 centers the center conductor 142 in retainer 150. Finally, in FIG. 4*h* the compression sleeve 130 is moved along coaxial cable 138 and engages the outer cable jacket 134 and braid 136 with the first end 104 of main body 102.

Figure 5:
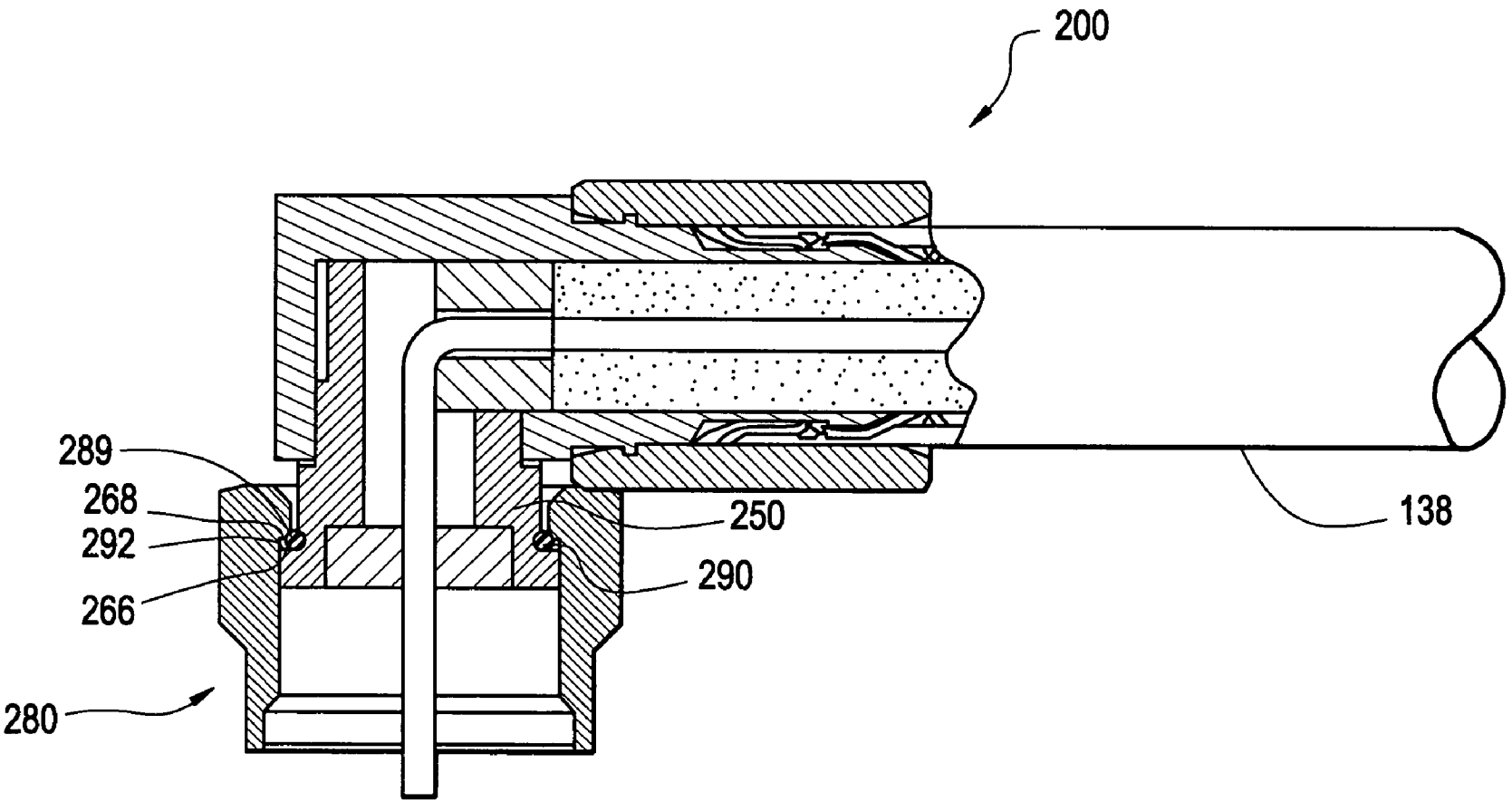
FIG. 5 is a cross-sectional view of a second embodiment of a right-angled connector according to the present invention.
Figure 7:
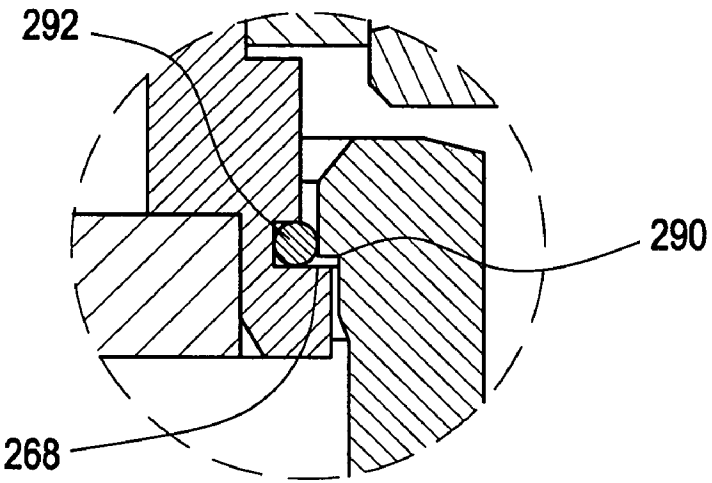
FIG. 7 is an enlarged view of the seal between the coupler and the retainer of the right-angled connector in FIG. 6.
Figure 6:
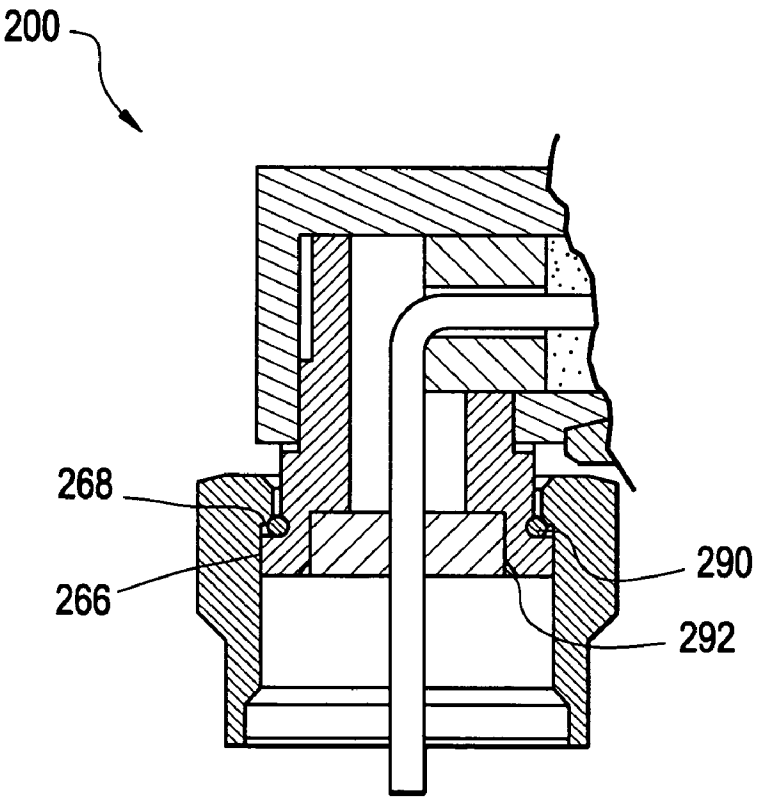
FIG. 6 is a cross-sectional view of a portion of the right-angled connector in FIG. 5 with the coupler in a second position.

A second embodiment of a right-angled coaxial cable connector 200 is illustrated in FIGS. 5-7. In this embodiment, the right-angled coaxial cable connector 200 is similar to the right-angled coaxial connector as in the previous embodiment, but also has a seal 290 that is disposed in a groove 292 in the corner of annular rib 266 and backward facing annular face 268 of retainer 250. While, in the embodiment illustrated, a groove 292 is present in the retainer 250, the seal may simply be disposed in the corner of the annular rib 266 and backward facing annular face 268. The seal 290, which is preferably made from ethylene propylene diene monomer or EPDM, also engages the reduced portion 289 of coupler 280, sealing the right-angled coaxial cable connector 200 from the ingress of moisture. FIG. 5 illustrates the coupler 280 in rearward position relative to the retainer 250, that is before being attached to a terminal. FIG. 6 illustrates the location of the coupler 280 relative to the retainer 250 and the seal 290 when the coupler 280 is attached to a terminal, i.e., in a forward position. As is best seen in FIG. 7, the seal 290 is compressed into the groove 292 and also between the retainer 250 and the coupler 280, sealing the junction of those two components. As a result, right-angled coaxial cable connector 200 may be used outdoors or in other environmentally wet or unfriendly locations.

Figure 8:
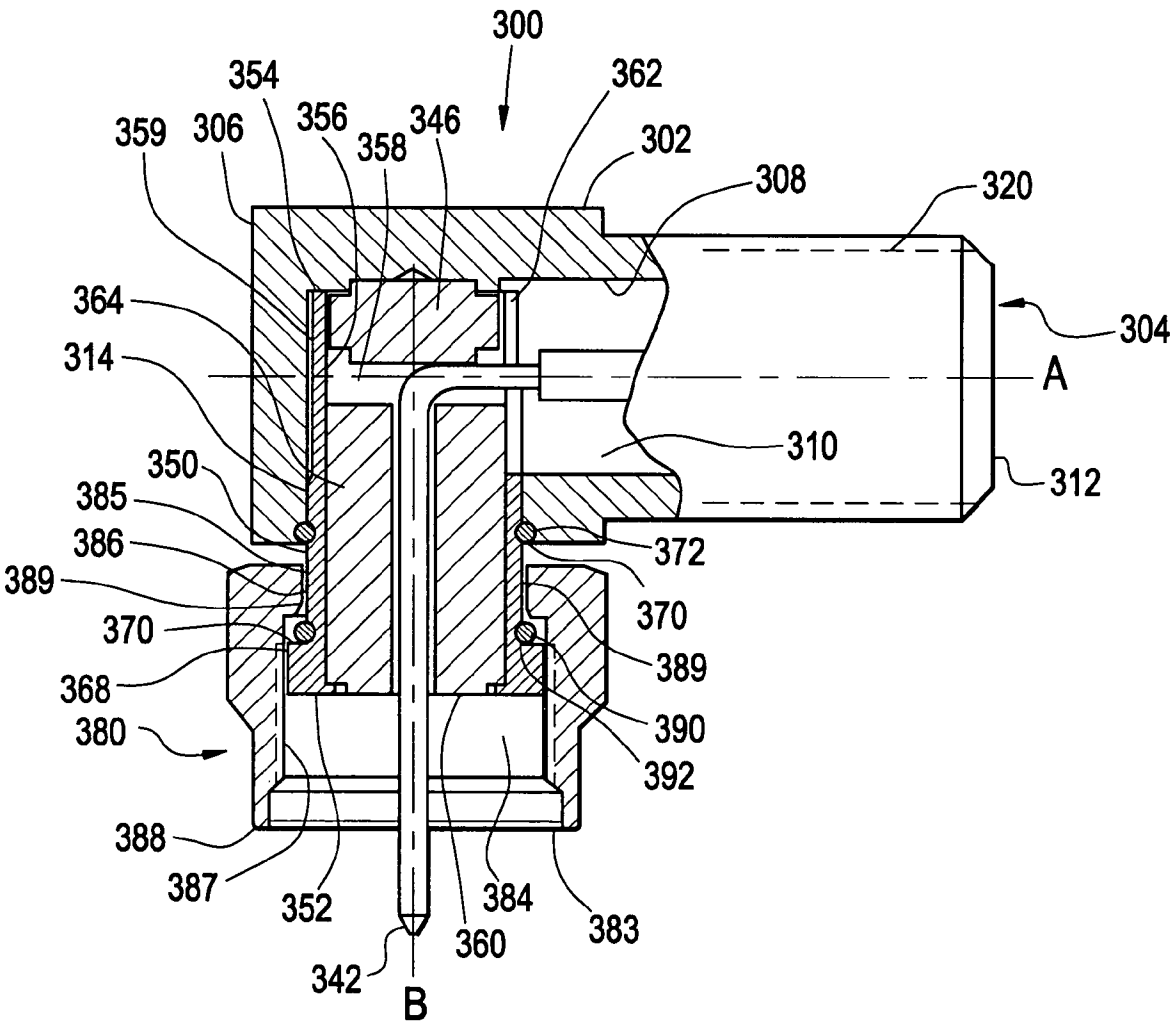
FIG. 8 is a cross-sectional view of another embodiment of a right-angled connector according to the present invention.

Another embodiment of a right-angled coaxial cable connector 300 in accordance with the present invention will now described with reference to FIG. 8. The coaxial cable connector 300 has a main body 302 with a first end 304, a second end 306, and an internal surface 308 extending between the first end 304 and the second end 306 to define a longitudinal opening 310. The main body 302 has a first opening 312 at the first end 304 and a second opening 314 at the second end 306. The first opening 312 has a longitudinal axis A extending perpendicularly therethrough (and parallel to longitudinal opening 310) and second opening 314 at the second end 306 also has a longitudinal axis B extending perpendicularly therethrough and is perpendicular to the longitudinal axis A that extends through the first opening 312. The main body 302 is preferably made from a conductive material such as brass and is preferably plated with a corrosion resistant material, for example, nickel.

First end 304 has internal threads 320 to engage a terminal or other connector and may be either a male or female interface. As is known in the art, the connection type is based on the center conductor, rather than by the threads that may be present.

The right-angled coaxial cable connector 300 also has a retainer 350 that has a front end 352, a rear end 354, and an internal surface 356 that defines a longitudinal opening 358 that extends between the front end and rear end 352,354. The retainer 350 is preferably made from an electrically conductive material such as brass and is preferably plated with a conductive material such as tin. The retainer 350 is preferably press-fit into the second opening 314 of the main body 302 such that the rear end 354 engages at least a portion of the internal surface 308 of the main body 302. The engagement of the rear end 354 with the internal surface 308 of the main body 302 makes the combination much stronger than the prior art where there was no contact with the internal surface of the main body. An outside surface 359 of the retainer 350 also engages the main body 302 at the second opening 314. The retainer 350 has a first opening 360 at the front end 352 and a second opening 362 at the rear end 354. Second opening 362 is positioned such that the longitudinal opening 358 is in communication with the longitudinal opening 310 of main body 302.

At the second opening 314 at the second end 306, a seal 370 is disposed in a groove 372 in main body 302. The seal 370 engages both the main body 302 and the outside surface 356 of retainer 350 to prevent moisture from entering into main body 302. The seal 370 is preferably made from ethylene propylene diene monomer or EPDM, or any other appropriate material.

Rather than the center conductor of coaxial cable passing through the coaxial cable connector, a one-piece continuous electrical conductor 342 extends between the first end 304 of main body 302 and front end 352 of retainer 350. As used herein, one-piece continuous electrical conductor means an electrical conductor that does not have multiple connections and/or joints and is constructed as a single, unitary conductor. As noted above, one end of the one-piece continuous electrical conductor 342 located at the first end 304 may have either a male or female configuration. As depicted in FIG. 8, the end of the one-piece continuous electrical conductor 342 located at the front end 352 of retainer 350 has a male configuration for connection to a terminal as with the prior embodiments.

A first insulator 346 is disposed adjacent the 90° bend in the one-piece continuous electrical conductor 342 and against the internal surface 308 of main body 302. The first insulator 346 is also adjacent the rear end 354 of retainer 350. The first insulator 346 provides for good impedance matching as well as support for the one-piece continuous electrical conductor 342. A second insulator 364 is disposed in the longitudinal opening 358 that extends between the front end and rear end 352,354 to provide support and center the one-piece continuous electrical conductor 342 in retainer 350.

A coupler 380 rotatably engages an outside surface 359 of retainer 350. Coupler 380 is preferably made from a conductive material such as brass and is plated with a corrosion resistant material, for example nickel. Alternatively, coupler 380 may also be constructed from an engineered polymer. The coupler 380 shown in FIG. 8 is in the form of a coupling nut, wherein internal surface 383 includes an internal chamfer 385, an inwardly projecting annular ridge 386, internal threads 387, and an internal recess 388. The reduced diameter of annular ridge 386 defines a reduced diameter through-bore section 389 of internal bore 384 of coupler 380. The increased diameter of internal recess 388 defines an increased diameter through-bore section 383 of internal bore 384. Coupler 380 may also take other forms in other embodiments.

Coupler 380 is capable of rotating around the retainer 350, that is, the diametral relationship of outer surface 359 and bore 384 allows coupler 380 to rotate about retainer 350 when coupler 380 is disposed about the retainer 350. Forward movement of coupler 380 relative to retainer 350 is restrained by engagement of annular rib 368 and backward facing annular face 370 with the reduced diameter through-bore section 389, thereby preventing coupler 380 from falling off from the front end 352 of retainer 350.

Figure 9:
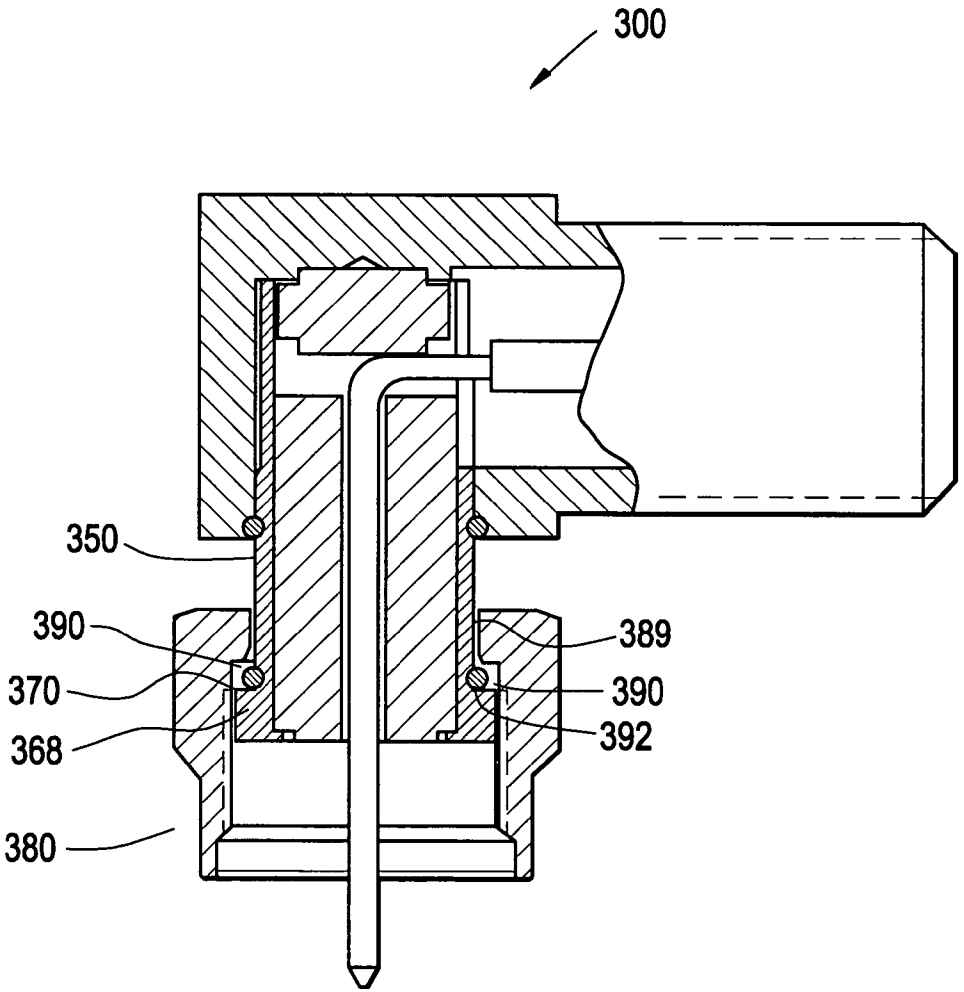
FIG. 9 is a cross-sectional view of the right-angled connector in FIG. 8 with the coupler in a second position.

Retainer 350 also has a seal 390 that is disposed in a groove 392 in the corner of annular rib 368 and backward facing annular face 370 of retainer 350. While a groove 392 is present in the retainer 350, the seal 390 may simply be disposed in the corner formed by the annular rib 368 and backward facing annular face 370. The seal 390, which is also preferably made from ethylene propylene diene monomer or EPDM, also engages the reduced portion 389 of coupler 380, sealing the right-angled coaxial cable connector 300 from the ingress of moisture. FIG. 8 illustrates the coupler 380 in rearward position, that is before it would be attached to a terminal. FIG. 9 illustrates the location of the coupler 380 relative to the retainer 350 and the seal 390 when the coupler 380 is attached to a terminal. As is best seen in FIG. 9, the seal 390 is compressed into the groove 392 and between the retainer 350 and the coupler 380, sealing the junction. As a result, the right-angled coaxial cable connector 300 may also be used outdoors or in other environmentally wet or unfriendly locations.

Figure 10:
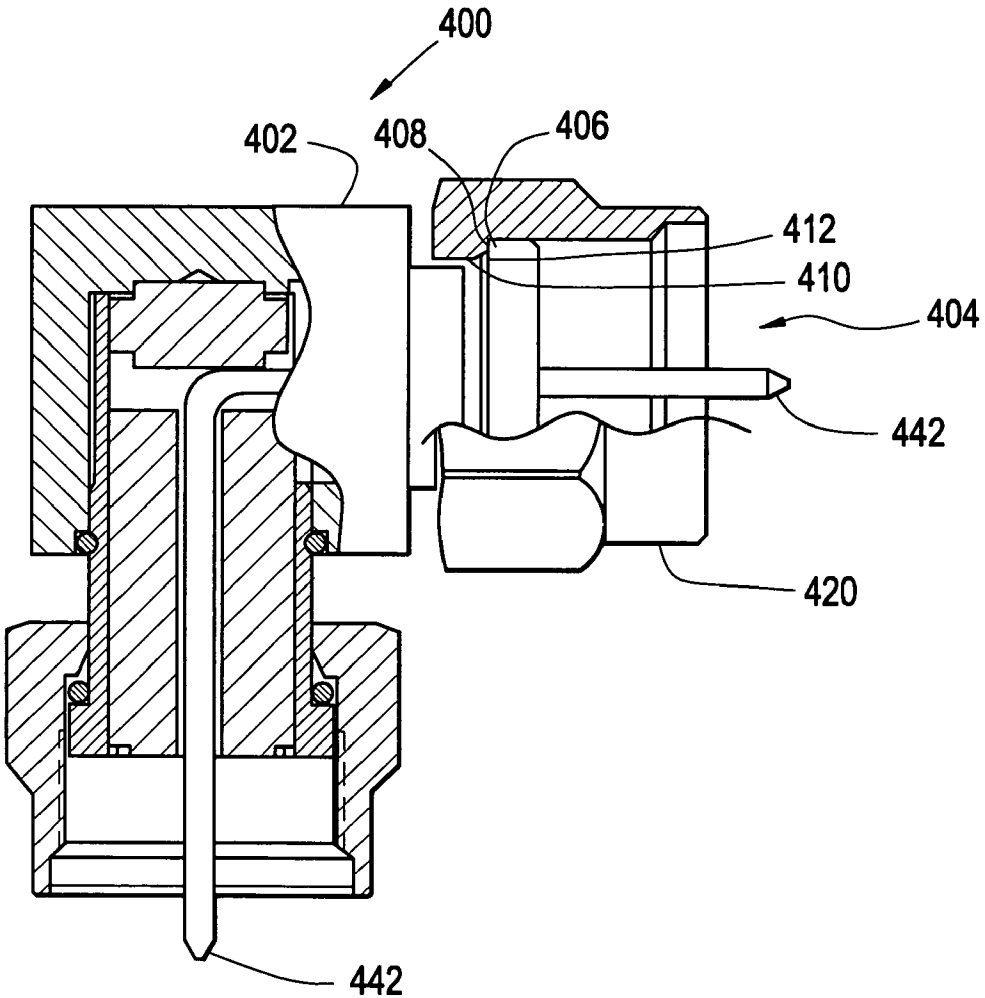
FIG. 10 is a cross-sectional view of another embodiment of a right-angled connector according to the present invention.

Another embodiment of a right-angled coaxial cable connector 400 in accordance with the present invention will now be described with reference to FIG. 10. Right-angled coaxial cable connector 400 is similar to right-angled coaxial cable connector 300 except that the first end 404 of main body 402 has a male configuration and a coupling nut. Additionally, the one-piece continuous electrical conductor 442 has a male configuration at both ends. Right-angled coaxial cable connector 400 has an annular rib 406 at first end 404 and backward facing annular face 408 to engage the second coupling nut 420. The first end 404 also has a groove 410 to hold a seal 412. Coupling nut 420 preferably has the same construction as the other coupling nuts disclosed herein. The combination of the structure of the first end 404, the seal 412, and the coupling nut 420 all provide for a moisture-tight configuration at the first end 404 as well.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A right-angled coaxial cable connector comprising:

a main body having a first end and a second end, and an internal surface extending between the first and second ends of the main body, the internal surface defining a longitudinal opening, the main body also having a first opening at the first end and the second opening adjacent the second end, each opening having a longitudinal axis therethrough, the longitudinal axis of the first opening being generally perpendicular to the longitudinal axis of the second opening;

a retainer having a rear end, a front end, and an internal surface extending between the rear and front ends of the retainer, the internal surface defining a longitudinal opening, the retainer disposed through the second opening and into the longitudinal opening of the main body, at least a portion of the rear end of the retainer engaging at least a portion of the internal surface of the main body;

a coupler disposed proximate the front end of the retainer to engage a terminal, the coupler having a portion with a hexagonal outer configuration; and an electrical conductor disposed in the longitudinal openings of the main body and the retainer, the electrical conductor being bent through an angle of about 90° to extend through the longitudinal opening of the retainer and out of the front end thereof.

2. The right-angled coaxial cable connector according to claim 1, wherein the electrical conductor is a one-piece continuous electrical conductor.

3. The right-angled coaxial cable connector according to claim 1, wherein the electrical conductor is a center conductor of a coaxial cable.

4. The right-angled coaxial cable connector according to claim 1, wherein the rear end engages at least a portion of the internal surface of the main body opposite the second opening of the main body.

5. The right-angled coaxial cable connector according to claim 1, further comprising an insulator disposed in the longitudinal opening of the main body adjacent the second opening and at least partially extending into the longitudinal opening of the retainer.

6. The right-angled coaxial cable connector according to claim 1, further comprising a seal disposed between the coupler and the retainer to prevent moisture ingress.

7. The right-angled coaxial cable connector according to claim 1, further comprising a second insulator disposed in longitudinal opening of the retainer adjacent the front end thereof.

8. The right-angled coaxial cable connector according to claim 1, further comprising a seal disposed between the main body and the retainer to prevent moisture ingress.

9. The right-angled coaxial cable connector according to claim 2, further comprising an insulator disposed adjacent the rear end of the retainer and between the internal surface of the main body and the one-piece continuous electrical conductor.

10. The right-angled coaxial cable connector according to claim 2, wherein the first end of the main body has at least one thread on an external surface and the one-piece continuous electrical conductor has female configuration at the first end of the main body.

11. The right-angled coaxial cable connector according to claim 2, wherein the first end of the main body has at least one thread on an external surface and the one-piece continuous electrical conductor has male configuration at the first end of the main body.

12. A method of making a right angle coaxial cable connector assembly, the method comprising the steps of:

passing an end of a coaxial cable through a longitudinal opening in a compression sleeve;

passing an insulator over a center conductor of the coaxial cable;

passing the end of the coaxial cable into a longitudinal opening of a main body through a first end of the main body, the center conductor of the coaxial cable passing out of the longitudinal opening through an opening adjacent a second end of the main body;

bending the center conductor about the insulator through an angle of about 90°;

centering the bent center conductor in the opening in the second end of the main body;

moving the center conductor into a longitudinal opening in a retainer; and inserting the retainer into the opening at the second end of the main body so that the center conductor extends through a front end of the retainer.

13. The method of making a right angle coaxial cable connector assembly according to claim 12, further comprising the step of moving the compression sleeve relative to the main body and coaxial cable, wherein at least part of the compression sleeve surrounds at least part of the main body.

14. The method of making a right angle coaxial cable connector assembly according to claim 12, wherein the retainer includes a coupler disposed proximate the front end of the retainer to engage a terminal.

15. The method of making a right angle coaxial cable connector assembly according to claim 14, wherein the coupler is rotatably mounted on the post.

16. The method of making a right angle coaxial cable connector assembly according to claim 14, wherein the main body and the retainer are press fit together.

17. The method of making a right angle coaxial cable connector assembly according to claim 13, wherein during the moving step, a portion of the coaxial cable is sandwiched between the compression sleeve and the main body.

18. The method of making a right angle coaxial cable connector assembly according to claim 12, wherein after the step of passing the insulator over the center conductor, the center conductor is pre-bent so it will pass through the opening at the second end of the main body.

19. The method of making a right angle coaxial cable connector assembly according to claim 12, wherein the retainer has an insulator disposed at the front end thereof, the insulator causing the center conductor to be centered in the front end of the retainer.

* * * * *